US006060013A

United States Patent [19]

Le Brun et al.

[11] Patent Number: 6,060,013

[45] Date of Patent: May 9, 2000

[54] ROTARY GAS DISPERSION DEVICE FOR TREATING A LIQUID ALUMINIUM BATH

[75] Inventors: Pierre Le Brun, Saint Jean de Soudain; Catherine Xuereb; Joël Bertrand, both of Pechabou, all of France

[73] Assignees: Pechiney Rhenalu; Aluminium Pechiney, both of Courbevoie, France

[21] Appl. No.: 09/171,964

[22] PCT Filed: Jul. 23, 1997

[86] PCT No.: PCT/FR97/01367

§ 371 Date: Mar. 8, 1999

§ 102(e) Date: Mar. 8, 1999

[87] PCT Pub. No.: WO98/05915

PCT Pub. Date: Feb. 12, 1998

[30] Foreign Application Priority Data

Aug. 2, 1996 [FR] France ..... 96/09975

[51] Int. Cl.[7] ..... C21C 7/00

[52] U.S. Cl. ..... 266/217; 266/233; 266/235

[58] Field of Search ..... 266/216, 217, 266/233, 235; 222/606

[56] References Cited

U.S. PATENT DOCUMENTS

| | | | |
|---|---|---|---|
| 3,227,547 | 1/1966 | Szekely | 266/217 |
| 3,982,913 | 9/1976 | Feichtinger | 266/235 |
| 4,401,295 | 8/1983 | Yoshida | 266/235 |
| 5,160,693 | 11/1992 | Eckert et al. | 266/235 |

FOREIGN PATENT DOCUMENTS

| | | |
|---|---|---|
| 2073706 | 1/1994 | Canada . |
| 0073729 | 9/1983 | European Pat. Off. . |
| 0611830 | 8/1984 | European Pat. Off. . |
| 0347108 | 12/1989 | European Pat. Off. . |
| 0438004 | 7/1991 | European Pat. Off. . |
| 434765 | 10/1967 | Switzerland . |

*Primary Examiner*—Scott Kastler

*Attorney, Agent, or Firm*—Pollock Vande Sande & Amernick

[57] ABSTRACT

A rotary gas dispersion device for use in a liquid aluminium treatment vessel is disclosed. The device is useful for reducing surface disturbance, splashing and vortices while maintaining the effectiveness of the treatment. Said device includes a rotor (1) consisting of a set of blades (5) and a substantially flat disc (4) thereabove. Gas is injected through the central hub and side ports (10) between the blades. The ratio of the outer diameter of the rotor to the diameter of the central hub thereof is of 1.5–4.

4 Claims, 3 Drawing Sheets

ROTARY GAS DISPERSION DEVICE FOR TREATING A LIQUID ALUMINIUM BATH

FIELD OF THE INVENTION

The invention relates to a rotary gas dispersion device for the treatment of a bath of liquid aluminum or aluminum alloys. In the rest of this text, the word "aluminum" will be used in the generic sense to mean "aluminum and its alloys."

STATE OF THE ART

Liquid aluminum output from electrolysis cells or remelting furnaces contains dissolved impurities and impurities in suspension. The most important of these impurities are hydrogen, alkaline elements such as sodium or calcium and oxides (and particularly aluminum oxide itself).

Liquid aluminum is subject to various treatments to eliminate these impurities which have negative consequences on subsequent properties of the partly finished product. The most widespread of these treatments that uses a combination of chemical reactions and flotation phenomena, consists of adding an inert or reactive gas into the bath in the form of small bubbles. For example, an argon bubble will entrain a solid inclusion in suspension with it to the bath surface. Similarly, a chlorine bubble will react with the sodium contained in the bath and produce a sodium salt that will also be transported to the surface of the bath. These types of treatment by the action of gases can be carried out discontinuously in a furnace or in a crucible. But it is usually done continuously between the furnace and the casting machine in a treatment ladle like that shown diagrammatically in FIG. 1.

The liquid metal to be treated enters the first compartment (2) of the ladle through an inlet spout (1). As it passes through it is treated by gas bubbles (4) dispersed by the rotary device (3). The metal thus treated overflows into an outlet compartment (5) equipped with a baffle (6) and exits from the ladle through the outlet spout (7).

The gas to be dispersed in the liquid bath is sometimes still injected using simple tubes, but the most widespread technique consists of using a rotary dispersion device composed of a hollow rotation shaft through which the gas is inlet and a rotor with the most appropriate shape to disperse gas bubbles in the bath. Obviously, the treatment is most efficient when the exchange surface area between the bath and the gas is a maximum. This is obtained by designing the rotor to produce very small bubbles, to project these bubbles throughout the volume (with the smallest possible dead volume) and create recirculation within the bath itself so that the liquid comes into contact with the bubbles (always the smallest possible dead volume).

This search for maximum treatment efficiency by intense stirring in the volume of the bath results in permanent surface agitation, often called "surface waves," by splashes from the bath caused by large bubbles rising and by a vortex phenomenon around the rotation axis. These three phenomena create a risk of adding new inclusions into the bath and generating annoying oxidation of the liquid aluminum.

An attempt has been made to eliminate or reduce these disadvantages.

For example, U.S. Pat. No. 4,618,427 suggests a radical change in the technology of gas dispersion devices. This device does not have the disadvantages mentioned above, but this type of rotor only creates very slow recirculation of the liquid metal, which is equivalent to reducing the metal/gas interface and consequently the efficiency of the process.

Patent Application EP 0347108 proposes combining gas treatment and filtration in the same device. A filter layer is inserted between the gas injection rotor and the surface of the liquid metal. Gas bubbles pass through the filter and rise to the surface, and it is understandable that surface turbulence should be very small, since the filter distributes bubbles and interrupts any vigorous bubbling. However, this device has serious disadvantages: firstly, the filter layer is an expensive device, is difficult to use, gets clogged and must be periodically replaced; secondly, the size of the rotor is obviously small to facilitate its passage through the filter layer and to assure a seal in this position. The conical shape of distribution of bubbles output from this rotor may produce a good distribution of bubbles under the filter layer, but it leaves a large part of the ladle out of reach of these bubbles, and this is not compensated by toroidal recirculation of the liquid metal itself. Therefore the efficiency of the gas treatment is significantly reduced, which does not necessarily make it unusable in a mixed gas/filtration treatment device as described in this application, but it is not satisfactory for a treatment device using gas only.

Patent Application EP 0611830 proposes providing a baffle at the bottom of the treatment ladle over the entire width of the ladle. This baffle passes in front of the rotor(s) and modifies the bubble distribution and metal circulation fields, so that surface disturbances can be reduced or, which gives the same result, the quantity of injected gas and rotation speed of the rotor can be increased without increasing these surface disturbances. This solution has an important practical disadvantage. As the liquid metal passes through the ladle, dirt accumulates around the preferred area formed by the baffle and the baffle has to be cleaned very frequently under particularly difficult conditions.

Japanese Patent Application JP 06-273074 is designed to very precisely reduce surface agitation and describes a rotor improved for this purpose. Experience shows that the use of this type of rotor does attenuate the permanent "surface waves" phenomenon but splashes occur at the bath surface periodically and unexpectedly, and these have harmful consequences on the recovery of inclusions.

STATEMENT OF THE PROBLEM

Applicants have attempted to develop a rotary gas dispersion device that reduces surface agitation phenomena, occasional splashes and vortices without the need to make modifications to the ladle itself, such as using a filter layer or a baffle, and without reducing the efficiency of the treatment.

DESCRIPTION OF PREFERRED EMBODIMENT

The subject of the invention is a rotary gas dispersion device for continuous treatment of a liquid aluminum bath in a treatment ladle comprising a drive shaft used for the inlet of gas and a rotor, the rotor being composed of an even number of blades laid out in a star formation around a central hub and an approximately flat disk covering the star formed by the blades, the gas being injected into the bath through orifices located between the blades, the ratio of the outside diameter of the rotor to the diameter of its central hub being between 1.5 and 4, in which complete blades with a given contact surface area with the bath are alternated with small blades with a contact surface area with the bath 10% to 30% less than that of the contact surface of complete blades.

At the bottom end of the drive shaft, there is a threaded piece or part on which the rotor will be attached. The rotor itself comprises a central hub and a threaded tube that is used to fix the rotor onto the threaded piece or part of the drive shaft. Blades are fitted onto this central hub, laid out like spokes. The number of these blades may be variable, and may be even or odd. If the number of blades is too small, the agitation and therefore the efficiency of the treatment may be inadequate. If the number of blades is too large, the assembly will be more difficult to manufacture and therefore more expensive. The choice is made individually for each case depending on the volume of metal to be treated within a given time, the size of the ladle which may consist of one or several compartments, etc. Between six and eight blades is a good compromise under normal aluminum treatment conditions.

The blades are usually rectangular, but trapezoidal blades can also be used in which the height of the blade is less at the external end than it is at its connection to the central hub, or triangular blades can be used in which the height of the blade is zero at its external end. The shape of the blade must be such that, considering its height and the configuration of the injection orifices which will be described later, most of the injected gas is diverted and dispersed by the blade.

The rotor comprises an approximately horizontal disk which has a diameter equal to or close to the outside diameter of the star formed by the blades. This disk is positioned above the star formed by the blades. It is beneficial to make the upper surface of the disk slightly tronconic in order to facilitate flow of the liquid metal when the rotor is drawn vertically out of the ladle. It is recommended that the diameter should not be chosen to be less than the diameter defined by the star formed by the blades. As soon as the end of the blades goes beyond the disk diameter, the wave attenuation effect of the device is considerably reduced. However, in the other direction, the wave attenuation effect is maintained even if the disk diameter is greater than the diameter defined by the star formed by the blades. However, there is no good reason for adopting this type of configuration. And in the preferred version of the invention, the diameter of the disk and the outside diameter of the star defined by the blades are approximately the same.

The outside diameter of the rotor according to the invention is variable. As for rotors according to the prior art, it depends on the volume to be treated, the size of the ladle and the shape of the ladle with one or several compartments.

The rotor according to the invention is characterized by high blade lift ratio. The blade lift ratio may be defined as the ratio between the outside diameter of the rotor and the diameter of its central hub. Rotors according to the prior art have a low blade lift ratio since increasing the lift ratio would considerably increase the surface agitation. A typical example of a rotor according to prior art with low blade lift ratio is rotor A in the example given hereinbelow. However, there are limits to the increase in the blade lift ratio. Below a specific ratio, the rotor is difficult to manufacture, easily broken and expensive. Above a specific ratio, the beneficial effect of the blade lift ratio becomes negligible. A range of between 1.5 and 4 for this ratio gives a good compromise under normal conditions for cells in the aluminum industry.

The rotor according to the invention has an even number of blades, and "complete" blades alternating with blades with a surface area 10% to 30% less than the surface area of the complete blade.

The layout between the disk and the set of blades may be made in several ways. A first solution is to make the rotor by machining it in a single piece. Disk, blades and the central hub form a single piece assembly. Another solution is to make the rotor in two pieces: firstly the disk with its own attachment hub at the center fitted by threading on the drive shaft, and secondly the set of blades with its central hub. In this case, the rotor is made by successive adjustments of the disk and blades on the drive shaft.

The advantage of an assembly in two pieces is that the rotor can be made of different materials. For example, blades that are subject to higher stresses than the disk can be made from a harder material than the disk.

In general, the device according to the invention can be made from any material compatible with usage conditions (mechanical strength, resistance at high temperature, wear, etc.) and particularly with all materials already known for use in similar equipment (graphite, boron nitride, alumina, silicon nitride, ceramics in the SIALON family, etc.), the three pieces (drive shaft, disk and blades) possibly being made from different materials.

The gas injection orifices are perforated radially in the central hub on which the blades are fixed. The connection of these orifices at the gas inlet through the drive shaft will be described later.

Gas injection orifices are positioned and made such that the gas jet is generally at the height of the central area of the blade which will disperse it as it rotates.

DETAILED DESCRIPTION OF THE INVENTION

Figure 3A:
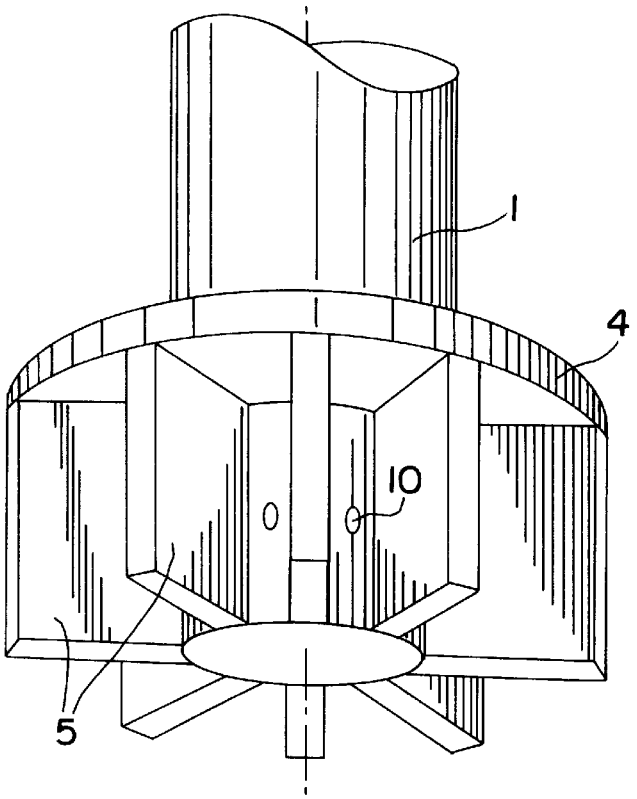
FIG. 3a PRIOR ART
FIG. 3*a* shows a rotary gas injection device with eight identical blades.

In its simplest, most rational and most efficient version, the rotor according to the invention comprises a gas injection between each blade through a single orifice positioned vertically at the mid-height of the blade, oriented radially such that its axis lies approximately along the bisector of the angle formed by the two blades and is drilled along a horizontal axis. This type of rotor is shown in FIG. 3*a* which shows the drive shaft (1), the upper disk (4), the blades (5) and a gas injection orifice (10).

However, very many variants are possible within the framework of the invention. For example, there is no need to inject gas along every center line between blades; it could be injected along every second center line. The efficiency of the assembly will be reduced but this may be sufficient in some circumstances, depending on the volume to be treated or the required metal quality. It would also be possible to position the orifice higher or lower than the mid-height of the blade, and/or incline the orifice below or above the horizontal. The important point is that most of the gas jet must be dispersed by the blade, preventing a significant part of the gas from escaping below or above the blade without being dispersed.

It is preferable that the orifice diameter be between 1 and 5 mm. If the diameter is smaller than 1 mm, there is a risk that the orifice could get clogged. If it is larger than 5 mm, the bubble diameter becomes too large, the metal/gas exchange surface area is reduced and the efficiency of the treatment may be compromised. In some configurations, depending on the volume to be treated, the rotor size and speed and the gas volume to be dispersed, it may be useful to replace the single orifice located between the blades by two or several smaller diameter orifices.

The orifices thus described, drilled in a star formation in the rotor central hub, may be connected to the gas supply through the hollow drive shaft by any type of means. These means depend on choices made elsewhere for the mechanical layout of the rotor and the shaft, as a function of the materials, the rotor size, etc. There is a very large number of these various possible means compatible with the invention, provided that they output a sufficiently regular gas flow well distributed in the various orifices.

Two possible solutions may be mentioned for supplying gas to the rotor orifices, although they do not in any way limit the scope of the invention.

Figure 4A:
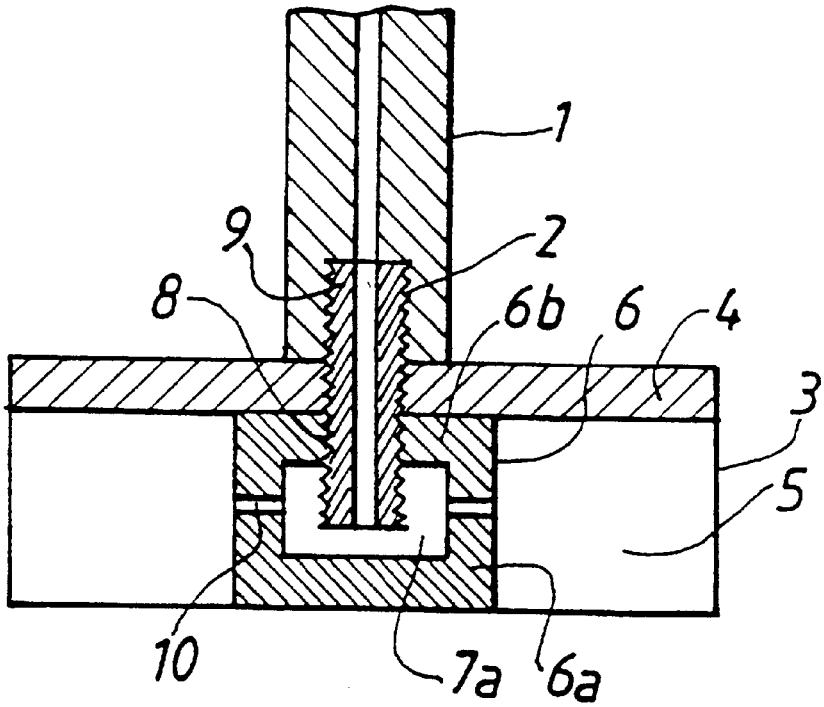
FIG. 4 shows two possible variants (4*a* and 4*b*) for assembly of the various elements of a device according to the invention and for supplying gas to the injection orifices.

One of these solutions is shown in FIG. 4*a*. A drive shaft (1) comprises a threaded cylindrical hole (2) at its lower end, that will be the female part of a screw connection. The rotor itself (3) made of a single piece comprises an upper disk (4), a number of blades (5) and a central cylindrical core (6). This central core (6) is solid at its lower part (6*a*), and comprises a cylindrical cavity (7*a*) that acts as the gas distributor. The orifices (10) are drilled radially starting from this cavity and distribute gas between the blades. A cylindrical threaded hole (8) with exactly the same diameter as the cylindrical threaded hole (2) in the drive shaft, also used as the female part for the screw connection, passes through the disk (4) and the upper part (6*b*) of the central core and leads into the central gas distribution cavity. Finally, the assembly comprises a cylindrical shaped screw (9) with a hole in its center forming a duct through which gas passes. During assembly, the first step is to fix the screw to the rotor in the threaded cylindrical hole (8) provided for this purpose. The rotor is then fixed to the drive shaft by screwing the upper part of the screw (9) that projects above the disk into the threaded cylindrical hole (2) provided in the shaft. Once the assembly has been put together, the gas passes through the central duct in the drive shaft, and is distributed through the central duct provided in the screw (9), the distribution chamber (7) and the lateral orifices (10).

Figure 4B:
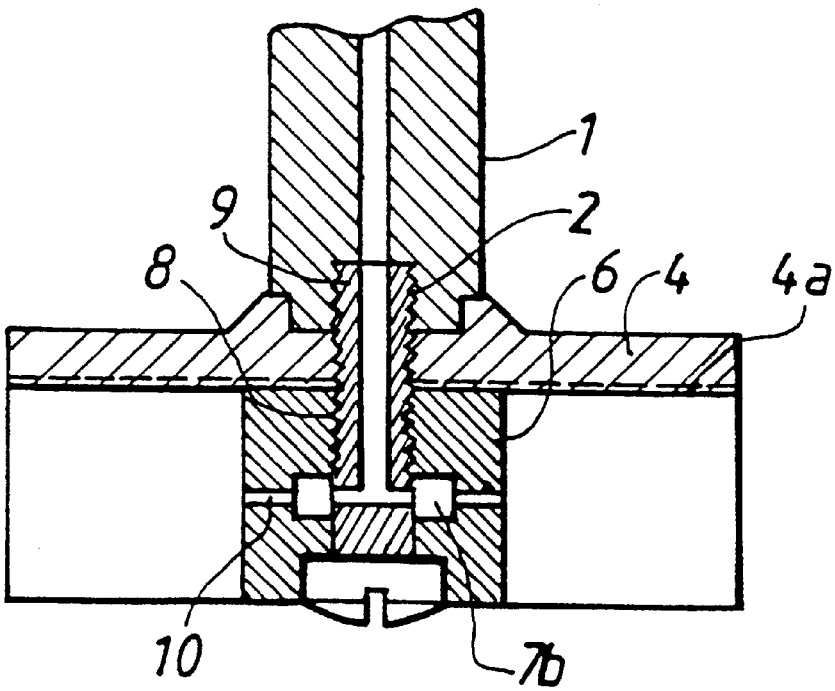

Another solution for assembly of the rotor/shaft and gas distribution is shown in FIG. 4*b*. The drive shaft (1) comprises a threaded cylindrical hole (2) that will be the female part of the screw connection. The rotor is in two parts: the upper disk (4) is made separately and attached to the assembly consisting of the blades and the central assembly core only. The lower surface of the upper disk (4) is provided with grooves (4*a*) into which the upper part of the blades fit at the time of assembly. The center of the disk is drilled with a threaded cylindrical hole into which the connection screw will fit. The central core (6) of the rotor itself is drilled with a threaded cylindrical hole (8) into which the connection screw will fit. A circular cavity (7*b*) is also formed in this central core at the mid-height of the blades, which will act as a gas distributor. Gas injection orifices (10) between the blades start radially outwards from this cavity. Finally, the assembly comprises a screw (9) through the center of which a gas duct passes. This duct will be connected to the drive shaft duct at the upper part of the screw, and at the lower part ends in a series of small radial ducts which, once the assembly is put together, lead into the gas distribution chamber. During assembly, the screw (9) is inserted into the lower part of the central core. Due to the threaded parts of the upper part of the central core, the disk and the lower part of the drive shaft, the screw (9) holds the assembly of the three pieces together. Once the assembly has been put together, the complete gas circuit is made up starting from the central duct in the drive shaft, passing through the central duct in the screw, the small lateral ducts inside the screw, the distribution chamber formed inside the central core and the injection orifices between the blades.

The rotor according to the invention has an even number of blades, "complete" blades alternating with blades in which the contact surface area with the bath is 10 to 30% less than the surface area of the complete blade. The surface area of the lower part of every second blade may be reduced in several ways, partly depending on the shape chosen for the "complete" blade. For example, one way would be to alternate "complete" rectangular shaped blades with blades with a smaller surface area in which only the height of the rectangle is reduced. Rectangular shaped blades could also be alternated with trapezoidal blades with the same height at the hub but with a smaller height at the tip of the blade. Other configurations are possible, the important point for the blade with a reduced surface area and for the "complete" blade being that the combination of the shape of the blade/position of the orifices is such that most of the gas jet is diverted and dispersed by the blade. In some cases this could mean that the position of the orifices in front of the blade with a reduced surface area is different from the position of the orifices in front of "complete" blades. But it would also be possible to choose shapes of "complete" blades and blades with a reduced surface area such that orifices could be positioned in exactly the same way for all blades.

The important point if the result is to be optimized is that the surface area of the blades is sufficiently large and that "complete" blades are alternated with blades with a reduced surface area. The favorable effect of alternating blades on the occurrence of surface waves, splashes and vortices, which has not been explained at the present time, becomes significant when one blade out of two has a surface area reduced by 10%. When the reduction in the surface area of every second blade reaches 30%, the efficiency of the treatment (all other parameters being equal) starts to reduce, probably because stirring is insufficient.

EXAMPLE

Figure 1:
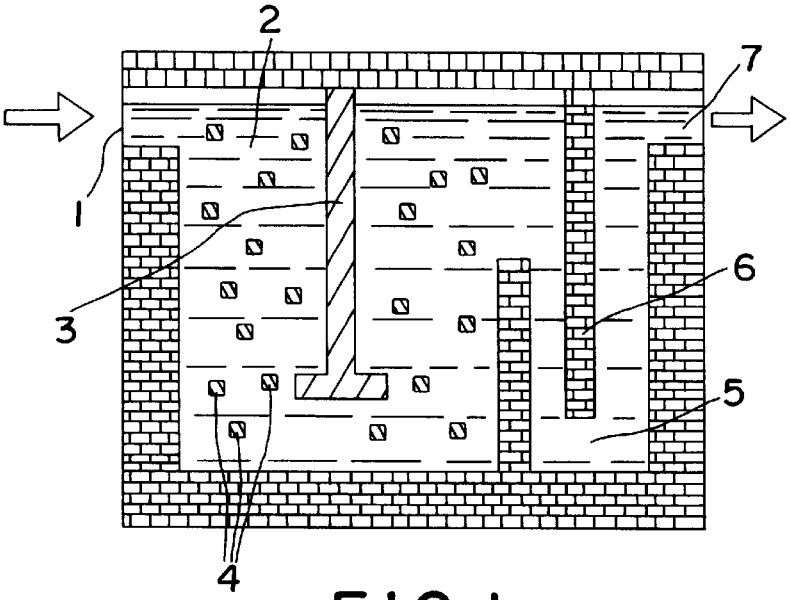
FIG. 1 PRIOR ART
FIG. 1 shows a cross section of a conventional continuous liquid aluminum treatment ladle with a rotor gas injection device.
Figure 2:
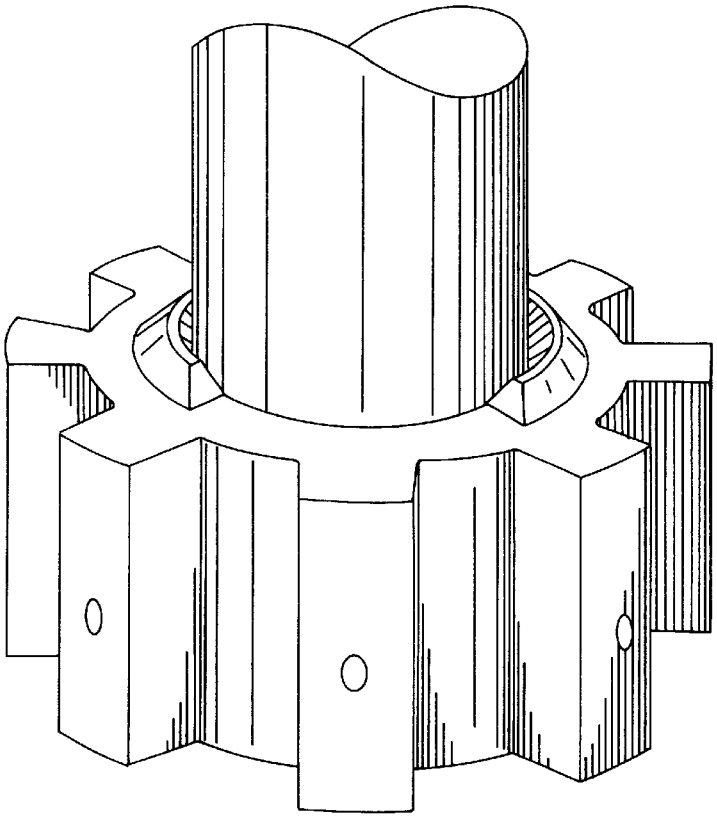
FIG. 2 PRIOR ART
FIG. 2 shows a rotary gas injection device according to the prior art.

Tests on the following devices were carried out in a ladle with inside dimensions 800 mm×800 mm×800 mm filled with 1200 kg of liquid aluminum:

(1) A device A according to prior art, frequently used in recent industrial installations and shown in FIG. 2. The outside diameter of the rotor was 250 mm and it comprised eight identical rectangular shaped blades 100 mm high in the vertical direction and 30 mm wide in the horizontal direction. The diameter of the central hub was 190 mm. The ratio between the outside diameter of the rotor and the diameter of its hub (the blade lift ratio) was 1.3. Gas was injected according to the principle of this conventional rotor through eight 2.5 mm diameter holes that discharge at the end of the blade.

(2) A device B shown in FIG. 3*a*. This device comprised a 15 mm thick disk with an outside diameter of 250 mm. It comprised eight identical rectangular shaped blades with a constant height in the vertical direction of 85 mm and a width in the horizontal direction of 75 mm. The diameter of the central hub was 100 mm. The ratio of the outside diameter of the rotor to the diameter of the central hub was 2.5. Gas was injected according to the invention through eight orifices located in the same horizontal plane, distributing gas jets horizontally directed approximately along the bisectors of the angles formed by two successive blades and approximately at mid-height of the blades. The diameter of these orifices was the same, 2.5 mm.

Figure 3B:
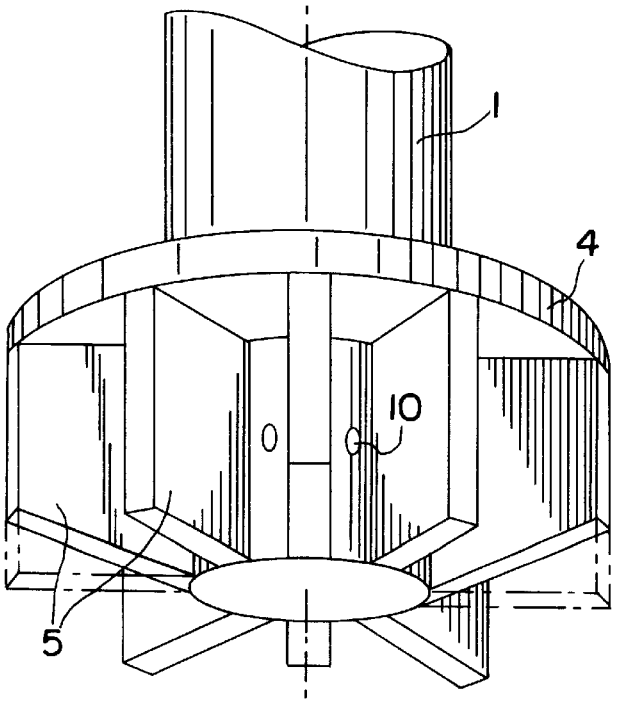
FIG. 3*b* shows a rotary gas injection device according to the invention with alternated complete blades and blades with a small surface area.

(3) A device C according to the invention and shown in FIG. 3*b* with the same dimensions as device B, but comprising "complete" blades alternating with blades with a reduced surface area. Four blades, identical to the blades in device B, had a constant height in the vertical direction of 85 mm. The other four blades alternated with the previous blades had a height varying from 85 mm at their connection to the central hub to 65 mm at the tip of the blade. The gas, as for device B, was injected through 2.5 mm orifices located in the same horizontal plane distributing jets horizontally at the mid-height of the blades, regardless of whether they were complete or truncated.

The parameters measured or observed during the test were the frequency of splashes, the vortex depth, the amplitude of surface waves, and the efficiency of the treatment. The following results were obtained:

The number of splashes was observed for a gas flow of 6 $Nm^3/h$ and a rotation speed of 250 rpm. The number of splashes per unit time was reduced by a factor of 2 with device B and a factor of 3 with device C, compared with the number of splashes per unit time observed with the reference device A.

Measurements of the vortex depth (in cm) were deliberately made without gas injection. The results are shown in Table 1.

TABLE 1

| Rotation speed in rpm | 250 | 300 | 350 |
|---|---|---|---|
| Device A | 2 | 4 | 7 |
| Device B | 1 | 3 | 5 |
| Device C | 1 | 3 | 5 |

The amplitude of surface waves is very difficult to measure, and was therefore evaluated by the naked eye for a gas flow of 6 $Nm^3$ h and two rotation speeds. The observations are given in Table 2.

TABLE 2

| Rotation speed (in rpm) | 250 | 350 |
|---|---|---|
| Device A (prior art) | medium | large |
| Device B | small | medium |
| Device C (according to the invention) | very small | small |

The treatment efficiency was measured by the percentage reduction in the $H_2$ content in the liquid metal after six minutes of treatment with a gas flow of 6 $Nm^3$ /h. The results obtained during the tests were of the same order of magnitude for the three rotors tested, with reduction rates of between 60 and 75%.

What is claimed is:

1. Rotary gas dispersion device for the continuous treatment of a liquid aluminum bath in a treatment ladle comprising a hollow drive shaft used for the inlet of gas and a rotor, the said rotor being composed of an even number of blades laid out in a star formation around a central hub and an approximately flat disk covering the star formed by the blades, the gas being injected into the bath through orifices located between the blades, the ratio of the outside diameter of the rotor to the diameter of its central hub being between 1.5 and 4, wherein complete blades with a given contact surface area with the bath are alternated with blades with a contact surface area with the bath 10% to 30% less than the contact surface are of the complete blades.

2. The device according to claim 1, wherein the number of blades is between 6 and 8.

3. The device according to claim 1, wherein the vertical position of the gas injection orifices is approximately at the mid-height of the blade, that they are drilled approximately horizontally and that their center line is approximately along the bisector of the angle formed by the two blades.

4. The device according to claim 1, wherein the diameter of the orifices is between 1 and 5 mm.

* * * * *